US006568473B2

(12) United States Patent
de Almeida

(10) Patent No.: US 6,568,473 B2
(45) Date of Patent: May 27, 2003

(54) GAS LIFT VALVE WITH CENTRAL BODY VENTURI

(75) Inventor: Alcino Resende de Almeida, Rio de Janeiro (BR)

(73) Assignee: Petroleo Brasileiro S.A. -Petrobras (BR)

( * ) Notice: Subject to any disclaimer, the term of this patent is extended or adjusted under 35 U.S.C. 154(b) by 0 days.

(21) Appl. No.: 10/050,584

(22) Filed: Jan. 18, 2002

(65) Prior Publication Data

US 2002/0096332 A1 Jul. 25, 2002

(30) Foreign Application Priority Data

Jan. 23, 2001 (BR) ..... 0100140

(51) Int. Cl.[7] ..... E21B 34/10

(52) U.S. Cl. ..... 166/250.15; 166/321; 166/117.6; 166/372; 166/374; 137/155

(58) Field of Search ..... 166/321, 117.5, 166/117.6, 369, 370, 372–374, 250.15; 137/155

(56) References Cited

U.S. PATENT DOCUMENTS 5,707,214 A * 1/1998 Schmidt
5,743,717 A * 4/1998 Schmidt
6,070,608 A 6/2000 Pringle

* cited by examiner

*Primary Examiner*—Roger Schoeppel
(74) *Attorney, Agent, or Firm*—Nixon & Vanderhye PC

(57) ABSTRACT

The present invention relates to a gas lift valve for use in an oil well producing by means of gas lift, said gas lift valve making use of a central body venturi for both controlling the flow of the injection gas from the annulus between the tubing and the casing of the oil well, and precluding a reverse flow of fluids from said oil well towards said annulus to occur.

24 Claims, 8 Drawing Sheets

GAS LIFT VALVE WITH CENTRAL BODY VENTURI

FIELD OF THE INVENTION

The present invention relates to a gas lift valve for use in an oil well producing by means of gas lift. More particularly, the present invention relates to a gas lift valve which makes use of a central body venturi for both controlling the flow of injection gas from an annulus between the tubing and the casing of the oil well, and precluding a reverse flow of fluids from the oil well to said annulus to occur.

STATE OF THE ART

Oil is usually found in accumulations under pressure in the subsoil, in porous and permeable sandstones known as reservoir stones, or simply reservoir, or yet producing rocking formations. Wells are drilled from the surface to drain off such reservoirs so as to communicate the reservoir with processing facilities in the surface, which are assembled to collect and to process the produced fluids.

Wells are bores which cross several rocking formations. Usually a steel pipe is inserted in such bores, named casing. At least one pipe of smaller diameter, named tubing, is inserted in such casing, through which fluids from the reservoir flow.

Oil is a complex mixture of heavy and light hydrocarbon phases, which may comprise from dry gas (methane) to heavy oil. Depending on the features of the reservoir, some components may appear in higher concentration than others. Some other substances may also accompany the produced oil, like water, carbon dioxide, hydrogen sulphide, salts and sand, etc.

Depending on the conditions of pressure and temperature, the constituents of the oil may be in a gaseous phase or in the liquid phase, or both. Thus, it should be concluded that the fluids that usually flow in an oil well may be considered as a multiphase multi component mixture.

The flow of fluids into an oil well, from the reservoir to the surface, occur as a consequence of the accumulated energy (pressure) in the reservoir, that is, without the presence of an external source of energy which provokes such production. In this case it is said that the well is flowing normally, or yet it is said that the well is producing by surge conditions. In case an external source of energy is used, e.g. a downhole pump, it is said that an artificial lift method is used.

Among the various known artificial lift methods, the continuous gas lift can be highlighted. In an usual configuration of this method, natural gas at high pressure is injected into an annulus formed between the casing and the tubing (or production string).

Valves known as gas lift valves are located at certain points of the tubing, which control the flow of gas flowing from the annulus to the interior of the tubing. The expansion of such pressurised gas and the consequent reduction of the multiphase mixture apparent specific gravity provide the necessary additional energy (pressure) to allow fluids from the reservoir to flow at a certain flow rate.

It is usual to control gas injection in an oil wells producing by continuous gas lift by means of a gas choke valve, located at the surface, and by another valve, which is the gas lift valve, located at the well bottom, at a certain location in the tubing.

Conventional gas lift valves used to control the rate of flow of injection gas in wells equipped to produce by means of continuous gas lift are not actually valves, although they are designated as valves by the experts and by the manufacturers. Actually they are flow regulators equipped with a small disc provided with a round orifice having a certain diameter. The edges of the orifice are usually sharp or smoothly rounded.

Such gas lift valves are also provided with a check valve, located downstream of the orifice, so as to preclude an undesirable flow of oil from the tubing to the annulus to occur.

Brazilian patent PI9300292-0, filed on Jan. 27, 1993 and commonly owned by the applicant of the present patent application, the description of which is herein incorporated for reference, disclosed an improved gas lift valve in which a venturi is used in place of the orifice of sharp edges usually used in conventional gas lift valves. According to this new conception, the irreversible losses of energy in the injection gas flow are significantly smaller, and a significant pressure recovery along the diffusor of the venturi occurs.

The critical flow of the injection gas is therefore achieved with a lower pressure head in the gas lift valve provided with a venturi than in a conventional gas lift valve, and thereby the flow rate of gas is kept constant more easily. As a consequence, the flow throughout the gas lift valve flows at a constant rate, whereby one of the worse operational problems occurring in oil well producing by means of continuous gas lift, the inconstancy of the flow rate, is overcome.

The ratio between the injection gas flow rate passing throughout the gas lift valve and the head of pressure between the intake port and the discharge port of the gas lift valve is usually referred to as the dynamic behaviour or dynamic performance of the gas lift valve. Thus, it can be said that a gas lift valve equipped with a venturi has a better dynamic performance than a gas lift valve equipped with an orifice.

Further, as a consequence of the lower pressure head required by the gas lift valve equipped with a venturi for injecting a certain rate of flow of gas, such gas lift valve provides a more rational use of energy, thereby provoking a reduction in the costs for compressing gas, considering the oil production flow rate being the same as the situation where a conventional gas lift valve is used, or instead augmenting the income by increasing the oil production flow rate, either by augmenting the injection gas flow rate or by injecting gas at a deeper location.

However, laboratory tests indicate that in many cases a good dynamic performance of the gas lift valve can be impaired by the check valve, which is usually located immediately after the venturi. Such check valve may cause a considerable constriction for the flow, in special in the situation where the features of the oil well require the use of venturis having throats of a large diameter for injecting significantly volumes of gas into the tubing.

The performance of a gas lift valve having a venturi decreases inasmuch as the diameter of the throat increases, due to the interference caused by the check valve, which, from a certain diameter of the throat on, exert a greater influence in the behaviour of the gas flow than the venturi.

The small space into a gas lift valve makes difficult to design a check valve which does not causes harmful effects to the dynamic performance of the gas lift valve. Moreover, as the check valve has movable parts in small spaces, such check valve is a jeopardy for a reliable operation of the gas lift valve, as a malfunctioning of the check valve can lead to an intervention in the oil well in order to replace the gas lift valve. In case the gas lift valve is installed in an undersea oil well, the costs for such intervention are very high.

The present invention proposes the use of a central body venturi which acts both as a venturi, enhancing the features of the injection gas flow, as previously mentioned, and also as a check valve, thereby eliminating the above drawbacks.

SUMMARY OF THE INVENTION

The present invention relates to a gas lift valve which makes use of a central body venturi for controlling the rate of the flow of injection gas and for preventing a reverse flow of fluids from the oil well to the annulus between the tubing and the casing of the oil well to occur.

The gas lift valve of the present invention should be used in a gas lift mandrel of an oil well producing by means of gas lift, the gas lift valve comprising:

a body;

a gas lift valve internal chamber;

at least one gas intake port for providing a passage for a flow of injection gas from an annulus between a casing and a tubing of said oil well to said gas lift valve internal chamber, said at least one gas intake port located in an upstream portion of said gas lift valve internal chamber; and a hollow tip, connected to said gas lift valve internal chamber, said hollow tip provided with at least one gas discharge port;

said gas lift valve further comprising:

a central body venturi installed in said gas lift valve internal chamber, said central body venturi comprising:

a first upstream divergent segment, which provides, in said gas lift valve internal, chamber a progressive constriction in a cross sectional area for the passage of said flow of injection gas;

a second intermediate segment, located downstream of said first upstream segment, which provides into said gas lift valve internal chamber a substantially constant cross sectional area for the passage of said flow of injection gas, such area being substantially smaller than the original cross sectional area of said gas lift valve internal chamber;

a third convergent downstream segment, located downstream of said second intermediate segment, which provides into said gas lift valve internal chamber a progressive widening in the cross sectional area for the passage of said flow of injection gas until such cross sectional area becomes equal to the original cross sectional area of said gas lift valve internal chamber; and a seat, located at said upstream portion of said gas lift valve internal chamber and downstream of said at least one gas intake port, said seat able to accommodate against its lower portion said first upstream segment of said central body venturi, thereby blocking off said gas lift valve and therefore precluding a reverse flow from said gas lift mandrel to said annulus to occur.

The central body venturi may be provided with primary and secondary fins for centring it in the gas lift valve internal chamber. Displacement limiters may also be provided for limiting the downward displacement of the central body venturi in the gas lift valve internal chamber.

A spring may be provided at the lower portion of the gas lift valve internal chamber for urging the central body venturi in a direction opposite to the direction of the flow of injection gas, so as to provide a faster blocking off of the gas lift valve in case a reverse flow occurs.

BRIEF DESCRIPTION OF THE DRAWINGS

The invention will be hereafter described in more details in conjunction with the drawings which, for illustration only, accompany the present report, in which.

DESCRIPTION OF PREFERRED EMBODIMENTS

Figure 1:
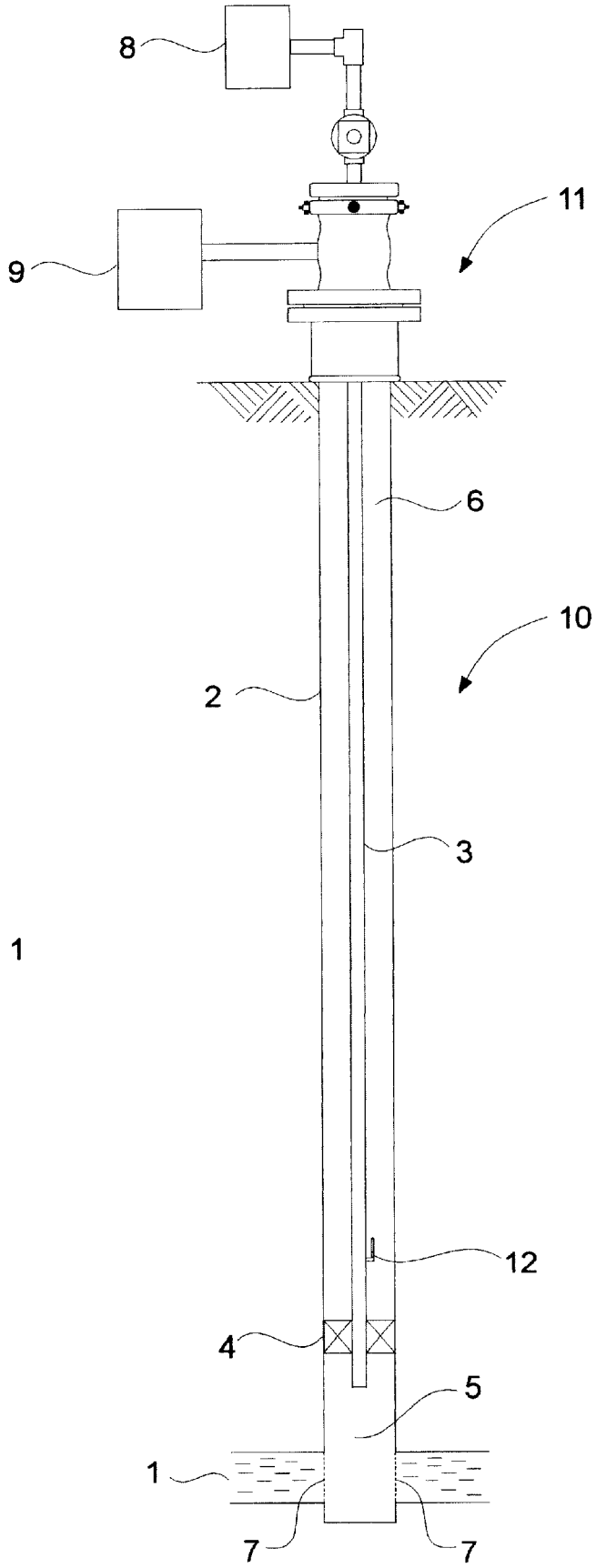
FIG. 1 is a schematic longitudinal cross sectional view partially depicting an oil well equipped for producing by means of continuous gas lift.

FIG. 1 is longitudinal cross sectional partial view which shows a typical gas lift facility, depicting an oil well 10 equipped to produce by means of continuous gas lift. Oil well 10 is basically a hole crossing a number of rock formations and extending from the surface to a reservoir 1. Oil well 10 is encased in its outermost part by a casing 2, a tubing 3 being inserted into said casing 2.

A packer 4 is installed in oil well 10, next to reservoir 1, and its function is to create two discrete zones into oil well 10, a first lower chamber 5, located next to reservoir 1, and a second upper chamber or annulus 6, formed between casing 2 and tubing 3, packer 4 providing a seal between the two chambers. At the surface there are facilities used to keep the operation of the well safe, which will be herein called as safety equipments and which are indicated in FIG. 1 by the numeral reference 11.

Fluids from reservoir 1 enter oil well 10 by means of small orifices 7, which were previously drilled in casing 2. Next the fluids flow in tubing 3 up to safety equipments 11, where they are directed to the processing facilities 8, which are schematically depicted in FIG. 1.

In the continuous gas lift system, a high pressure gas coming from an external source of high pressure gas 9, schematically shown in FIG. 1, is admitted in an annulus 6. The high pressure gas flows in annulus 6 and is injected in tubing 3 through a gas lift valve connected to a gas lift mandrel 12.

The lower and upper ends of gas lift mandrel 12 are respectively connected to upstream and downstream segments 3*a* and 3*b* (not shown in FIG. 1) of tubing 3. The injection gas mingles with the fluids coming from reservoir 1, and the resultant mixture is carried to the surface.

Although in the FIG. 1 a single gas lift mandril 12 is shown for installing a gas lift valve, oil wells producing by such means are usually provided with a number of gas lift mandrels, which are spaced apart along the tubing and which are each equipped with gas lift valves, the gas lift valves being not necessarily of the same type.

However, usually the injection of gas is made by means of a single gas lift valve, known as the operator gas lift valve. Some other gas lift valves are also installed in oil well, but they are used to assist the starting-up or restarting-up the oil well production, and these gas lift valves are known as start-up valves.

Oil wells equipped to produce by means of continuous gas lift may have other types of configuration than the configuration shown in the FIG. 1. Such oil wells may be onshore or offshore oil wells. The offshore oil wells may be equipped with dry wellheads (e.g. located at a production platform), or wet wellheads, that is, the wellhead is located at the seabed.

Moreover, in any of the abovementioned configurations use may be made of a single tubing 3, as shown in FIG. 1, or more than one tubing may be used instead (double completion, triple completion, etc.).

Whatever be the configuration of an oil well, the gas lift valve object of the invention may be used, as the type of configuration of the well will not affect the performance of the gas lift valve. Therefore, the configuration schematically depicted in the FIG. 1 sufficies for the experts to understand how the gas lift valve object of the invention operates, and it will be quite clear that the gas lift valve can be used in any tubing, as will be seen hereon.

Figure 2:
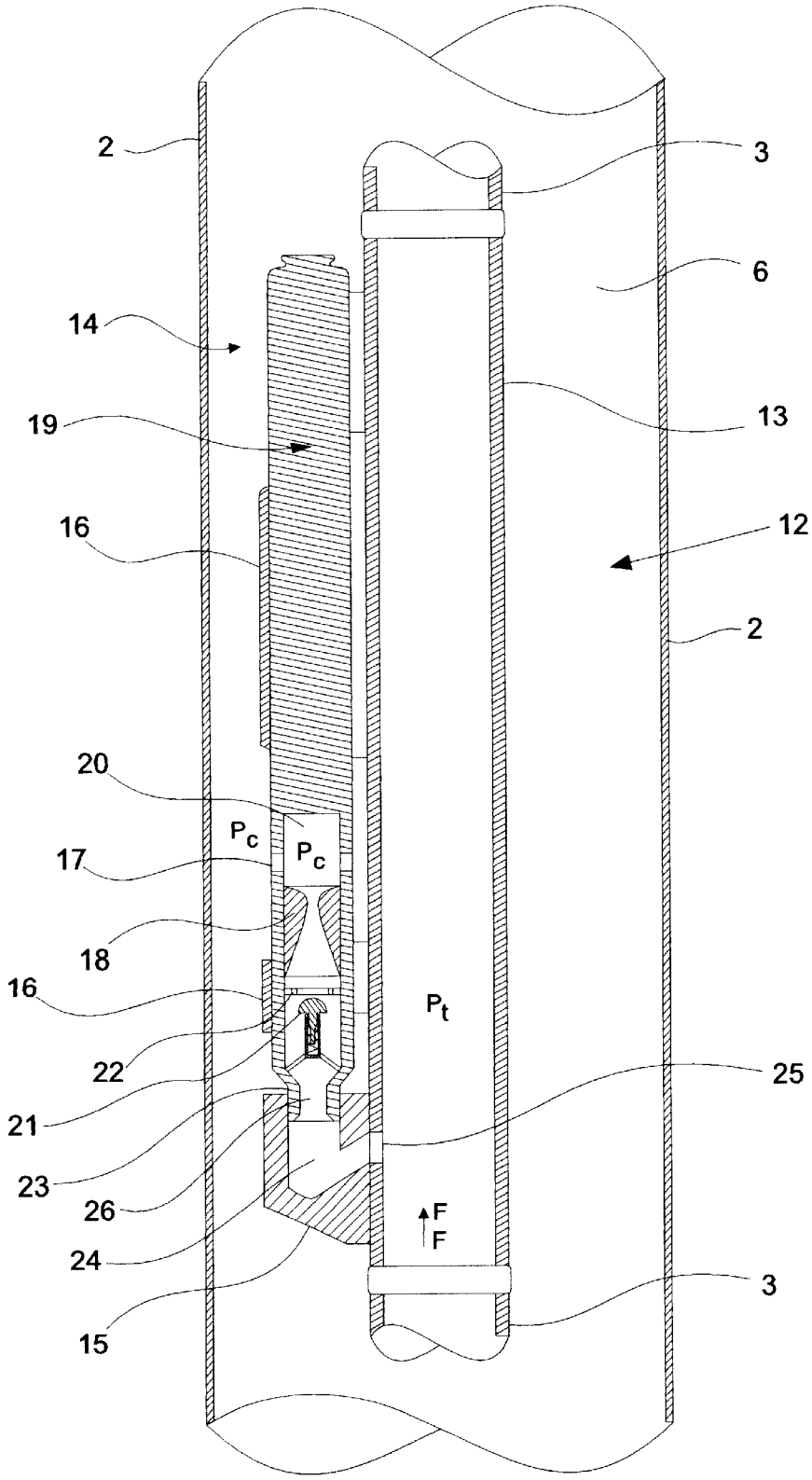
FIG. 2 is a longitudinal cross sectional view depicting a conventional gas lift mandrel having a central venturi type gas lift valve connected to it.

There are two types of gas lift mandrels, namely the conventional one and the side pocket one. FIG. 2 depicts a longitudinal cross section of a conventional gas lift mandrel 12 equipped with a gas lift valve 14. Conventional gas lift mandrel 12 comprises a body 13, which is a segment of pipe having the same internal diameter of tubing 3 of the oil well, and a side support 15, to which gas lift valve 14 is connected.

Body 13 is provided at its lower and upper ends with means for allowing it to be respectively connected to the upstream and downstream segments 3*a* and 3*b* of tubing 3, whereby the conventional gas lift mandrel 12 is in line with tubing 3.

Gas lift valve 14 shown in FIG. 2 is of the type which is provided with a concentric venturi, and it comprises a body 19 provided with an internal chamber 20. At least one gas intake port 17 connects annulus 6 to the upstream portion of the gas lift valve internal chamber 20. Usually more than one gas intake port 17 is used.

Internal chamber 20 is provided with a concentric venturi 18, located downstream of the gas intake port 17, a check valve assembly, which is formed by a shutter 21 and a seat 22 and which is located downstream of the concentric venturi 18, and a hollow tip 23, located downstream of the check valve assembly and provided with a gas discharge port 26.

Hollow tip 23 is provided at its outer portion with threads which enable gas lift valve 14 to be connected to conventional gas lift mandrel 12 by screwing hollow tip 23 in side support 15, with auxiliary supports 16 being provided in conventional gas lift mandrel 12 for laterally support body 19 of gas lift valve 14.

Side support 15 is provided with an internal chamber 24, which communicates with an end of hollow tip 23 of gas lift valve 14. The other end of the internal chamber 24 of side support 15 is connected to a gas discharge opening 25 existing in body 13 of conventional gas lift mandrel 12.

Gas at a high pressure from annulus 6 between tubing 3 and casing 2 is then able to pass successively through the gas intake port 17, concentric venturi 18, check valve assembly formed by shutter 21 and seat 22, gas discharge port 26 of hollow tip 23, internal chamber 24 of side support 15 and through gas discharge opening 25 in body 13, entering then into body 13 of conventional gas lift mandrel 12.

Fluids coming from reservoir 1 flow upwards into the upstream segment 3*a* of tubing 3, in the direction indicated by the arrow F—F, passing then in the body 13 of the conventional gas lift mandrel 12.

When passing in front of the gas discharge opening 25 the fluids receive an injection of gas at a high pressure coming from said gas discharge opening 25, whereby the fluids of the flow mingles with the injected high pressure gas, and the resultant mixture in then carried to the surface through the downstream segment 3*b* of tubing 3.

Such conventional gas lift mandrel 12 has a serious drawback in that it is required to retrieve the entire tubing 3 when it is necessary to replace the gas lift valve 14.

Figure 3:
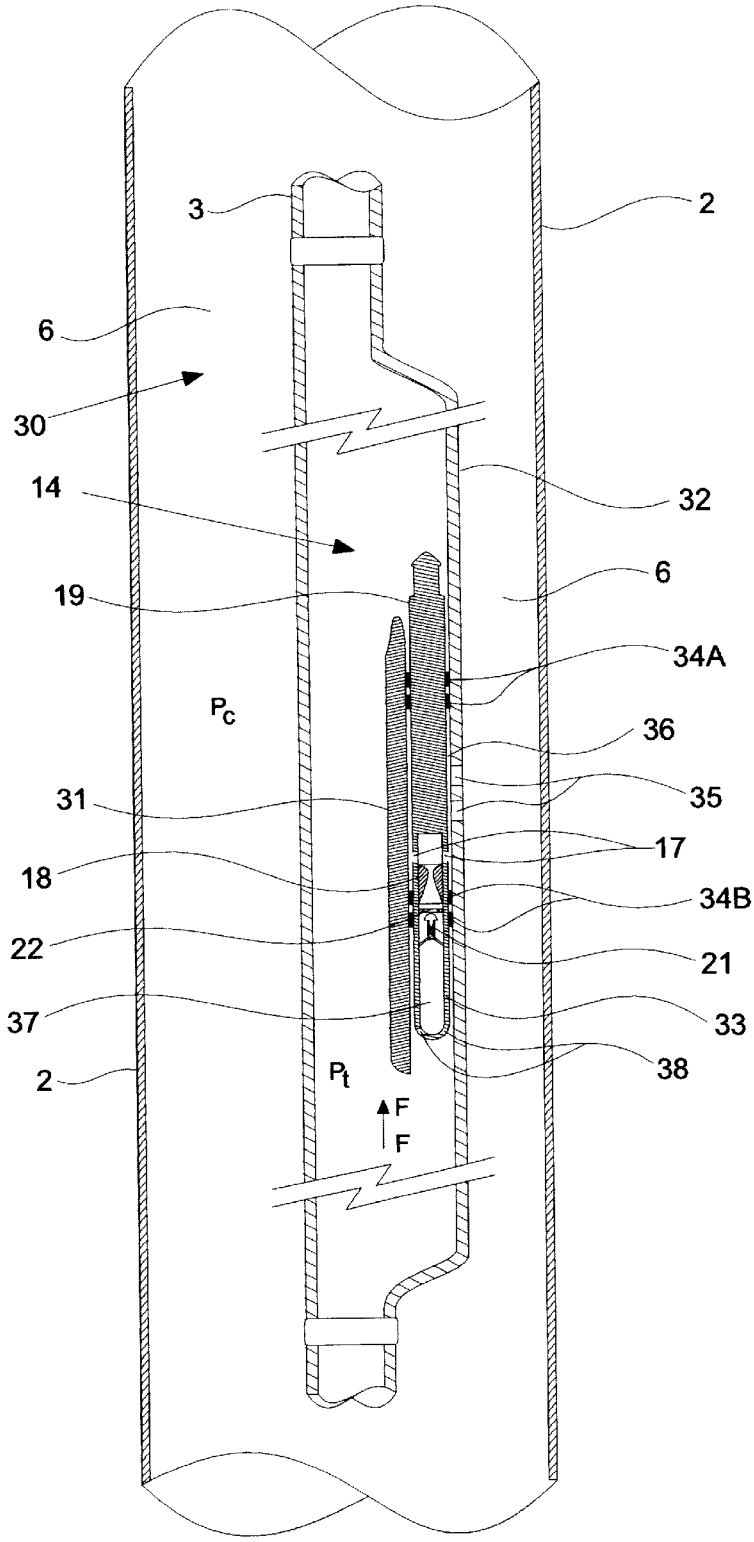
FIG. 3 is a longitudinal cross sectional view depicting a side pocket gas lift mandrel having a central venturi type gas lift valve connected to its side pocket.

FIG. 3 depicts a longitudinal cross section of a side pocket gas lift mandrel 30 having a venturi type gas lift valve 14' inserted in a side receptacle 31 of the side pocket 32 of the side pocket gas lift mandrel 30. Similarly to the conventional gas lift mandrel 12 of the FIG. 2, the side pocket gas lift mandrel 30 is provided with threads in its lower and upper ends, so as to allow them to be respectively connected to the upstream and downstream segments 3*a* and 3*b* of tubing 3.

Side pocket gas lift mandrel 30 is designed in such a way that a venturi type gas lift valve 14' can be replaced, when necessary, without the need of retrieving the entire tubing 3. Such replacement is made by means of an operation which requires special tools, which are inserted and lowered into tubing 3 by means of a cable or a wireline, such operation being well known by those skilled in the art.

Venturi type gas lift valve 14' is substantially equal to the one which has been described with respect to conventional gas lift mandrel 12 of FIG. 2, except for being provided with a hollow tip 33 which is distinct from hollow tip 23 of gas lift valve 14 of FIG. 2. Therefore venturi type gas lift valve 14' will not be described here and use will be made of the same numeral references used in the description of the FIG. 2.

Venturi type gas lift valve 14' is introduced in side receptacle 31 of side pocket 32, where it is kept under pressure due to the compression exerted by gaskets 34*a* and 34*b*, which also provide the necessary sealing between body 19 of venturi type gas lift valve 14' and side receptacle 31.

High pressure gas coming from annulus 6 between tubing 3 and casing 2 enters, through gas intake orifices 35 existing in side pocket 32, in small annulus 36 formed between receptacle 31, venturi type gas lift valve 14' and side pocket 32. Such small annulus 36 is kept sealed by gaskets 34*a* and 34*b*.

Next the high pressure gas enters venturi type gas lift valve 14', through gas intake ports 17, it passes successively through the concentric venturi 18 and the check valve assembly formed by shutter 21 and seat 22, and it then enters internal chamber 37 of hollow tip 33, and finally exits through gas discharge ports 38 located at the lower end of hollow tip 33.

Fluids coming from reservoir 1 flow upwards into upstream segment 3*a* of tubing 3, located below the side pocket gas lift mandrel 30, in the direction indicated by the arrow F—F—in FIG. 3, passing then into side pocket gas lift mandrel 30.

When passing in front of gas discharge ports 38 of hollow tip 33 of venturi type gas lift valve 14' the fluids receive a high pressure gas injection coming from the gas discharge ports 38, whereby the flowing fluids mingle with the injected high pressure gas. This mixture in then carried to the surface through the downstream segment 3*b* of tubing 3.

Taking a fixed diameter for concentric venturi 18, the gas flow rate passing through it is a function of the pressures downstream and upstream of said concentric venturi 18. The pressure upstream of the venturi is a pressure PC existing in annulus 6 at the region where gas lift valve 14' is located. For the sake of simplification, the pressure lost when high pressure gas flows through gas intake ports 17 are not taken in consideration.

The pressure downstream of concentric venturi 18 is a pressure $P_t$ existing in tubing 3 at the region where the gas lift valve 14' is located. For the sake of simplification, the pressure lost in the check valve assembly formed by shutter 21 and seat 22, at internal chambers 33, and in gas discharge ports 38 are not taken in consideration. If pressure $P_t$ is higher or equal to pressure $P_c$, a flow from annulus 6 to the interior of tubing 3 will not occur. Notice that the check valve assembly formed by shutter 21 and seat 22 prevents a flow of fluids from the interior of the side pocket gas lift mandrel 30 to annulus 6 to occur.

If pressure $P_t$ is rather smaller than pressure $P_c$, a flow from annulus 6 to the interior of the body of the side pocket gas lift mandrel 30 will occur. Supposing that pressure $P_c$ is constant, as pressure $P_t$ decreases, the gas flow rate will then increase, until pressure $P_t$ reaches the value of the critical pressure $P_{tcr}$, when the flow reaches the speed of sound in the throat of venturi 18.

When the critical pressure is reached in a flow of gas from a region of a higher pressure to a region of a lower pressure, an increase in the flow rate of the gas will not occur even if the pressure of the region of a lower pressure is reduced, and it is said that the sonic speed of the flow occurs, and the resultant constant flow is called the critical flow.

Notice that to say that a flow of gas at a high pressure from annulus 6 to the interior of the body of the side pocket gas lift mandrel 30 will or will not occur is tantamount to say that a flow of gas at a high pressure from annulus 6 to tubing 3 will or will not occur, as the lower and upper ends of the side pocket gas lift mandrel 30 are respectively connected to the upstream and downstream segments 3*a* and 3*b* of tubing 3, and therefore the side pocket gas lift mandrel 30 is part of tubing.

Although the flow rate behaviour of the high pressure injection gas as a function of the pressures $P_c$ and $P_t$ has been analysed with respect to a situation where use is made of a side pocket gas lift mandrel 30 provided with a gas lift valve 14', a substantially identical behaviour occurs in a situation where use is made of a conventional gas lift mandrel 30 provided with a gas lift valve 14.

However, in certain situations, pressure losses at the check valve assembly can be appreciably high, and therefore the pressure downstream of the concentric venturi 18 will no longer have the value $P_t$, but instead a value $P_t^*>P_t$, the value of $P_{t*}$ being a function of the rate of flow which crosses the check valve assembly.

Thus, instead of being provided with an element to regulate the flow of gas, the gas lift valve is actually provided with two elements (the concentric venturi and the check valve assembly) which, when operating in combination, do not operate as expected.

Therefore, the presence of the check valve assembly reduces the rate of flow of the high pressure injection gas which would be expected to occur for a certain differential pressure ($P_c-P_t$) and causes a delay in the occurrence of the critical flow, which would occur for a differential pressure ($P_c-P_t^*$) which is higher than those that would be required if only the concentric venturi were used.

The space in a gas lift valve for the check valve assembly is small, not only due to the small internal diameter of the gas lift valve, but also due to the small length available for installing it, as it is necessary to use a diffusor of a relatively long length for enhancing the efficience of the concentric venturi. Such limitation in the available space for the check valve assembly makes difficult to design a check valve assembly which does not cause significant disturbances to the gas flow.

Moreover, a conventional check valve assembly is usually subject to have a number of mechanical malfunctions, which impede it to work properly and which can lead to an operation in the oil well for the replacement of the gas lift valve.

The present invention relates to a new type of gas lift valve which overcomes the above problems, such gas lift valve combining the venturi and the check valve assembly in a single component, thereby doing away with the losses of pressure occurring in the check valve assemblies of the conventional gas lift valves of the prior art.

Figure 4:
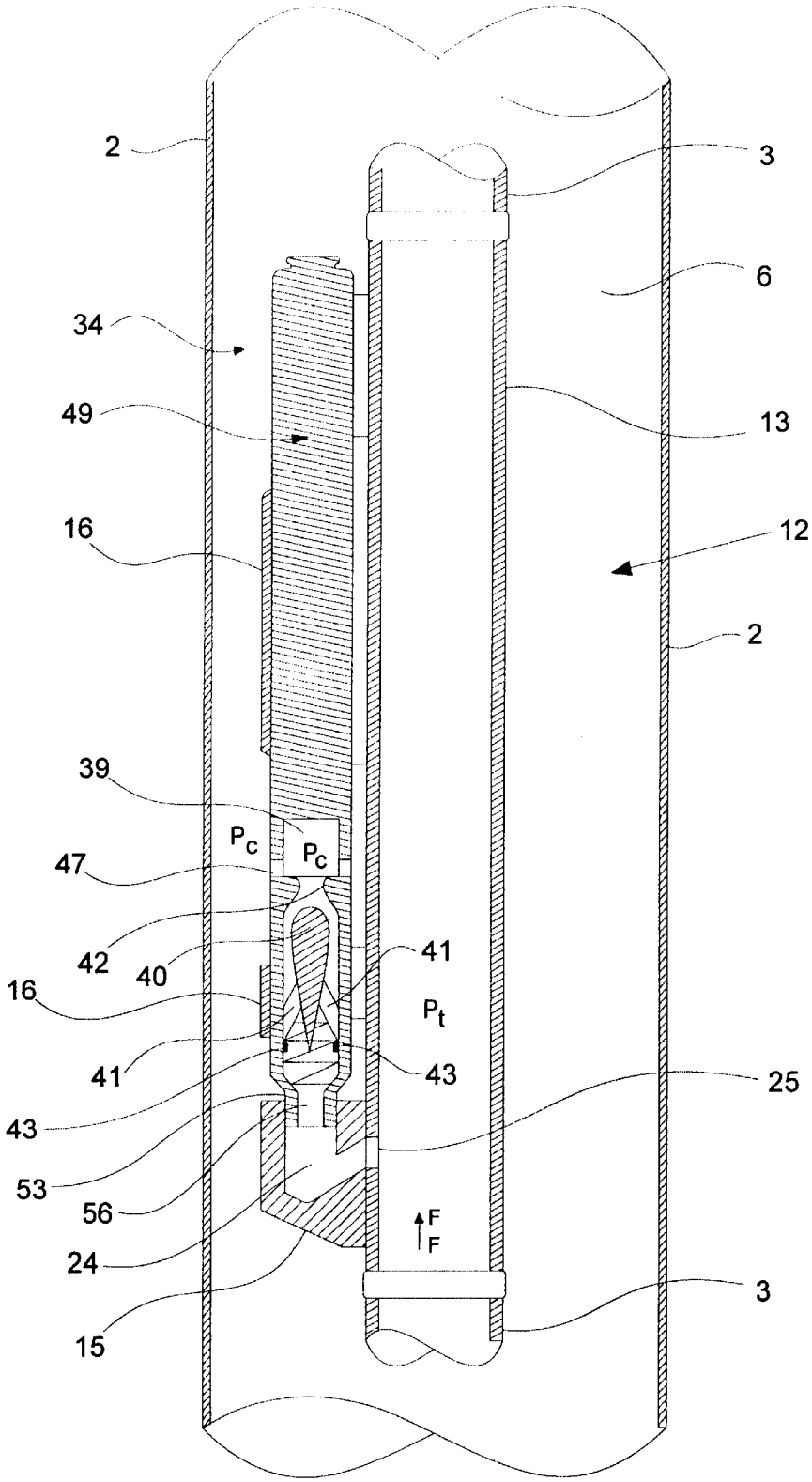
FIG. 4 is a longitudinal cross section view depicting a conventional gas lift mandrel having a venturi type gas lift valve of the present invention connected to it.

FIG. 4 depicts a first embodiment of a gas lift valve 34 object of the present invention, in a situation where a conventional gas lift mandrel 12 is used.

In this embodiment the gas lift valve 34 encompasses a body 49, at least one gas intake port 47, a central body venturi 40 provided with primary fins 41, such central body venturi 40 being located in a gas lift valve internal chamber 39, a seat 42 and a hollow tip 53, which is provided with a gas discharge port 56.

The central body venturi basically comprises three segments, namely:

- a first diverging upstream segment, which provides into the gas lift valve internal chamber 39 a progressive constriction in the cross sectional area for the passage of the flow of the high pressure injection gas;
- a second intermediate segment, located downstream of the first diverging upper segment, which provides into the gas lift valve internal chamber 39 a substantially constant cross sectional area for the passage of the flow of the high pressure injection gas, such area being substantially smaller than the original cross sectional area of the gas lift valve internal chamber 39;
- a third convergent downstream segment, located downstream of the second intermediate segment, which provides into the gas lift valve internal chamber 39 a progressive widening in the cross sectional area for the passage of the flow of the high pressure injection gas until such cross sectional area becomes equal to the original cross sectional area of the gas lift valve internal chamber 39.

Primary fins 41 serve to keep the central body venturi 40 centred in the gas lift valve internal chamber 39. Seat 42 should be able to allow the central body venturi 40 to seat accordingly against it, as will be seen hereupon. Use can be made of at least one displacement limiter 43 of the central body venturi 40 to limit the displacement of the latter in the gas lift valve internal chamber 39 towards hollow tip 53 when high pressure gas passes through gas lift valve 34 from annulus 6 to the interior of the conventional gas lift mandrel 12.

Hollow tip 53 of gas lift valve 34 is fixed to side support 15 of a gas lift mandrel 12, which is respectively connected at its upstream and downstream ends to the upstream and downstream segments 3*a* and 3*b* of tubing 3. As has been shown, side support 15 is provided with an internal chamber 24 and a gas discharge opening 25, which communicates with the interior of body 13 of gas lift mandrel 12.

In FIG. 4 the gas lift valve 34 is depicted in its open position, whereby gas from annulus 6 is able to pass through the gas intake ports 47, seat 42, to pass by the central body venturi 40 and is then able to be exhausted by gas discharge port 56 of hollow tip 53, towards internal chamber 24 of side support 15, exiting them through gas discharge opening 25 to the interior of body 13 of gas lift mandrel 12.

In case the flow from the interior of the body 13 of the gas lift mandrel 12 to annulus 6 tends to revert, this reverse flow will cause the central body venturi 40 to displace towards seat 42 and eventually the first diverging upper segment of the central body venturi 40 will be seated against seat 42, thereby promoting a blocking off which precludes such reverse flow from reaching annulus 6. Therefore, seat 42 and the first diverging upper segment of the central body venturi 40 act as the check valve assembly of the gas lift valves of the prior art.

Gas lift valve 34 may optionally be provided with a spring to provide a faster and more efficient seating of the first diverging upper segment of the central body venturi 40 against seat 42, in case a reverse flow occurs. A spring 48 is shown in FIG. 4, for exemplification only, which is located at the lower portion of the internal chamber 39.

Spring 48 accommodates to the lower part of the third convergent lower segment of the central body venturi 40 and urges the central body venturi 40 towards seat 42, in a direction which is contrary to the direction of the flow of the high pressure injection gas, whereby, in case a reverse flow occurs, the first diverging upper segment of the central body venturi 40 seats against seat 42, thereby providing a faster blocking off of said reverse flow.

However, the use of a spring as described should be avoided or the spring should only be used after a judicious analysis, with the purpose of causing a minimal disturbance in pressure recovery in the third convergent downstream segment of the central body venturi 40.

Figure 5:
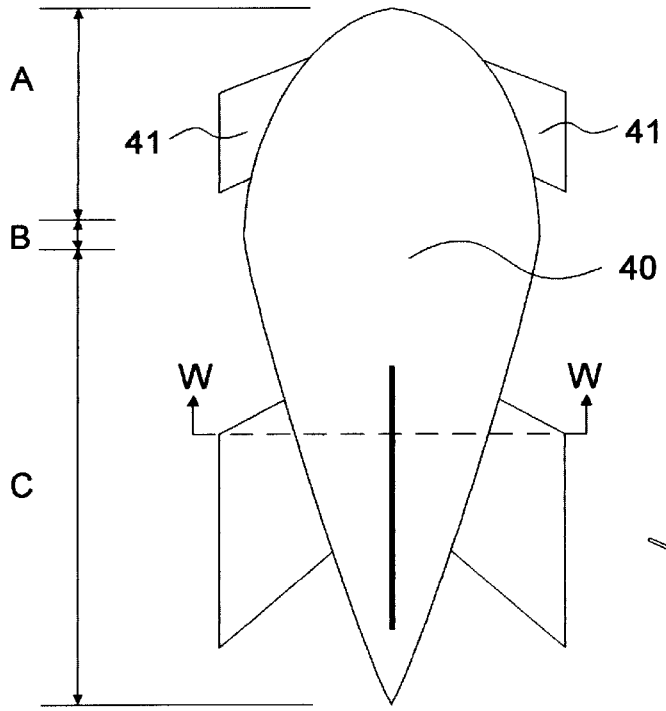
FIG. 5 is a front view of the central body venturi element of the gas lift valve object of the invention.

FIG. 5 depicts an enlarged view of the central body venturi 40. It can be seen that the latter encompasses a first divergent upstream segment A, a second intermediate segment B, of a constant cross sectional area, and a third convergent downstream segment C. Drawing an analogy with a classical conventional venturi, said first divergent upstream segment A may be designated as the nozzle, said second intermediate segment B may be designated as the throat, and said third convergent downstream segment C may be designed as the diffusor.

The second intermediate segment B, or throat, may comprise a segment of a very short length, which would only comprise basically the region where the curvature from the first divergent upstream segment A to the third convergent lower segment C of the central body venturi 40 is inverted. This is the preferred configuration for the second intermediate segment B, or throat, of the present invention.

The area for the passage of the flow of the high pressure injection gas formed at the annulus between the central body venturi 40 and the internal wall of the internal chamber 39 is progressively reduced at the region of the first divergent upstream segment A, or nozzle. Therefore, the flow of gas is progressively accelerated at this region, thereby causing a reduction in the pressure of the flow of the high pressure injection gas.

The area for the passage of the flow of the high pressure injection gas formed at the annulus between the central body venturi 40 and the internal wall of the internal chamber 39 is progressively enlarged at the third convergent downstream segment C, or diffusor. Therefore, the flow of gas is progressively decelerated at this region, thereby causing an increase in the pressure of the flow of the high pressure injection gas.

The greatest constriction to the flow of the high pressure injection gas occurs at the second intermediate segment B, or throat, and the flow of the high pressure injection gas is able to flow there at most at the speed of sound, which determines the maximal flow rate of injection gas which can flow throughout the gas lift valve.

Figure 6:
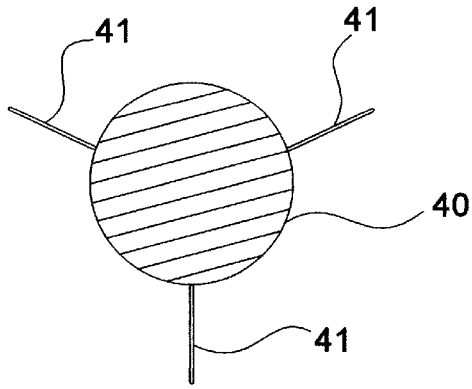
FIG. 6 is a transverse cross section view of the central body venturi element, taken along the cut line W—W of FIG. 5.

In the preferred embodiment of the present invention use is made of at least three primary fins 41 in order to centralise central body venturi 40 into internal chamber 39. Primary fins 41 are preferably located at the diffusor (third convergent lower segment C), as shown in FIG. 5, and they can be guided by rails. FIG. 6 is a cross sectional view taken at the line W—W of the FIG. 5, showing three primary fins 41 angularly spaced.

Secondary fins 41' may be provided at the nozzle (first divergent upstream segment A) of the central body venturi 40, if needed, in order to preclude vibration from occurring in the central body venturi 40.

Primary fins 41 and the secondary fins 41' should be thin and should be aerodynamically shaped, in order to cause the least disturbance to the flow of high pressure injection gas, for allowing a high pressure recovery at the diffusor (third convergent downstream segment C) to occur, similarly to that occurring in a conventional concentric venturi.

Figure 7:
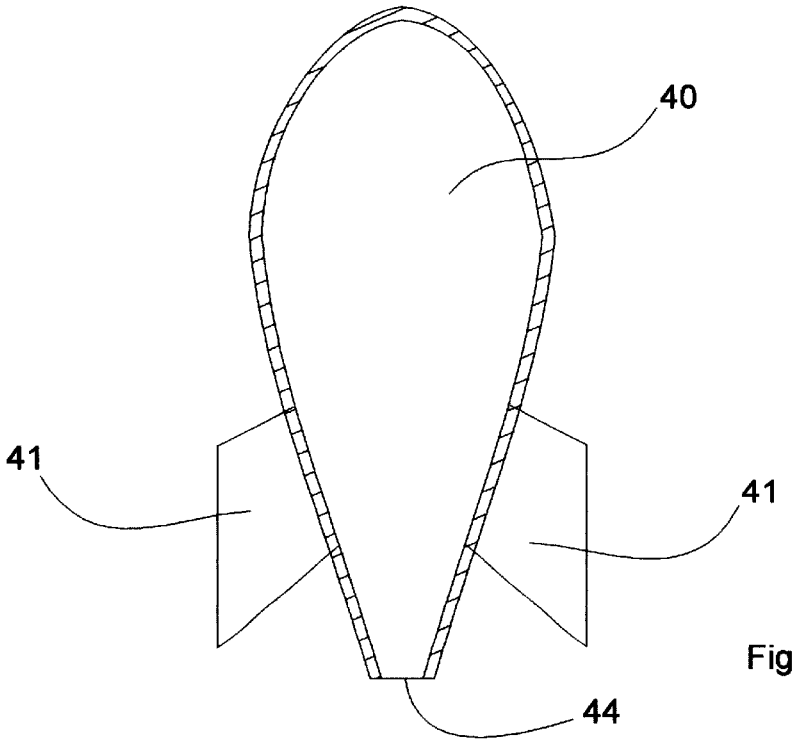
FIG. 7 is a partial longitudinal cross sectional view of an embodiment of the central body venturi element, which is hollow.

FIG. 7 depicts a cross sectional view of an alternative embodiment of a central body venturi 40', in which the latter is hollow and is provided with an opening 44 at the end of the third convergent downstream segment, which faces the hollow tip 53. The opening 44 provides an equalisation between the pressures in the central body venturi 40' and the pressure in the internal chamber 39 of the gas lift valve 34. In FIG. 7 only one opening 44 is shown. However, more than one opening 44 can be used.

Central body venturi 40' is lighter than the previous one, facilitating it to be displaced towards seat 42 by the flow of oil in case a reverse flow occurs. In other words, the central body venturi 40' is able to be more rapidly actuated in order to block off an undesirable reverse flow, if compared to the central body venturi 40 which has been previously described.

Figure 8A:
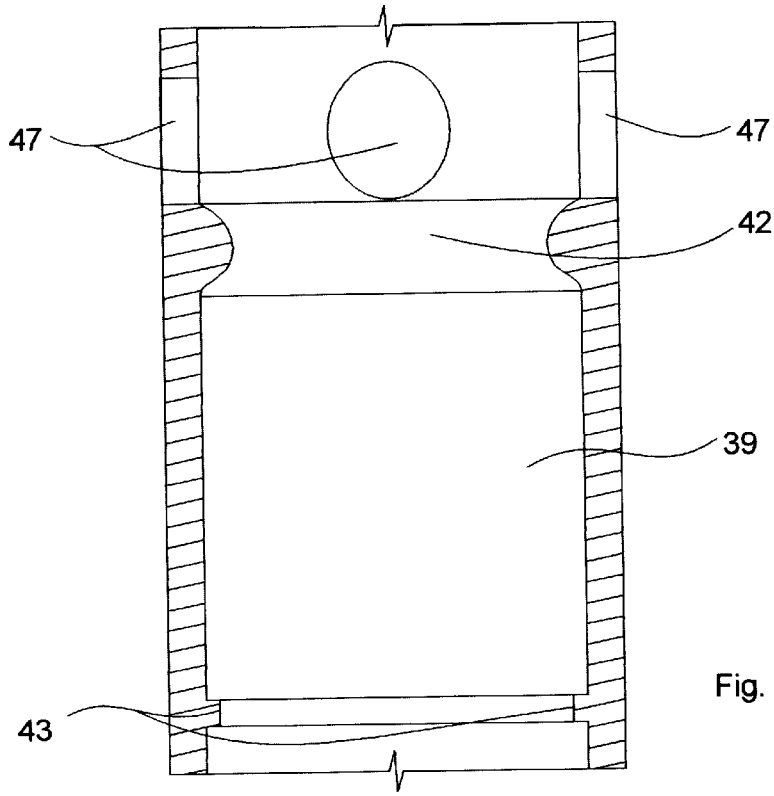
FIGS. 8A and 8B are longitudinal cross sectional views showing in more detail the seat for accommodating the central body venturi element and a displacement limiter.

FIG. 8A depicts a longitudinal cross sectional view of a segment of the internal chamber of a gas lift valve, the central body venturi being not shown. It can be seen: —the gas intake ports 47, —seat 42, against which the upper part of the central body venturi exerts a blocking off, —and a displacement limiter 43 of the central body venturi, which is located near the hollow tip (not shown in FIG. 8A) of the gas lift valve.

Displacement limiters 43 may or may not be used, although it is desirable to use them. A circular protrusion at the wall of the internal chamber, located near the hollow tip, can be used to act as a displacement limiter. Alternatively, the displacement limiter may comprise a narrowing in the diameter of the downstream segment of the internal chamber.

Figure 8B:
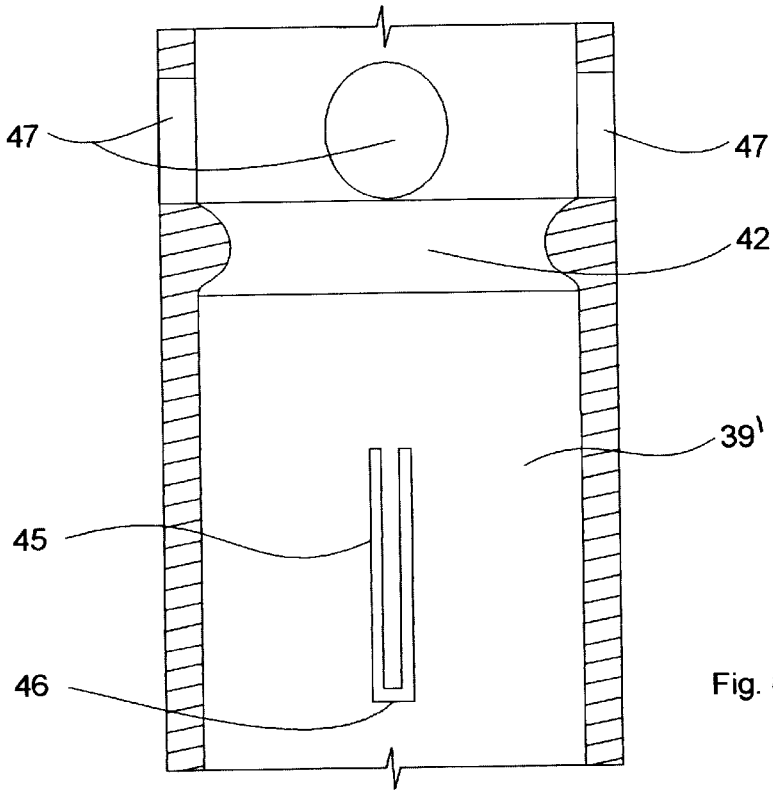

FIG. 8B depicts a segment of the internal chamber 39' of a gas lift valve similar to the one shown in FIG. 8A, with a rail 45 being provided in the internal wall of the internal chamber 39' of the gas lift valve and intended to serve as a guide to a primary fin 41, which is able to slide in the rail 45. A bumper 46, located at the lower portion of the rail 45 and near to the hollow tip (not shown in FIG. 8B), acts as a limiter for the descending displacement of the central body venturi.

Seat 42 should be aerodynamically shaped, in order to cause the least disturbance to the flow of high pressure injection gas. Seat 42 should also be shaped in such a way that it allows the nozzle (first divergent upstream segment A) of the central body venturi (40; 40') to seat against it without becoming stuck there. Seat 42 may be integral with the body of the gas lift valve, or it can be provided with an insert of a material of least superficial hardness than the superficial hardness of the nozzle (first divergent upstream segment A) of the central body venturi, thereby enhancing the blocking off effect. For example, a polymeric material can be used in the insert of seat 42.

Figure 9:
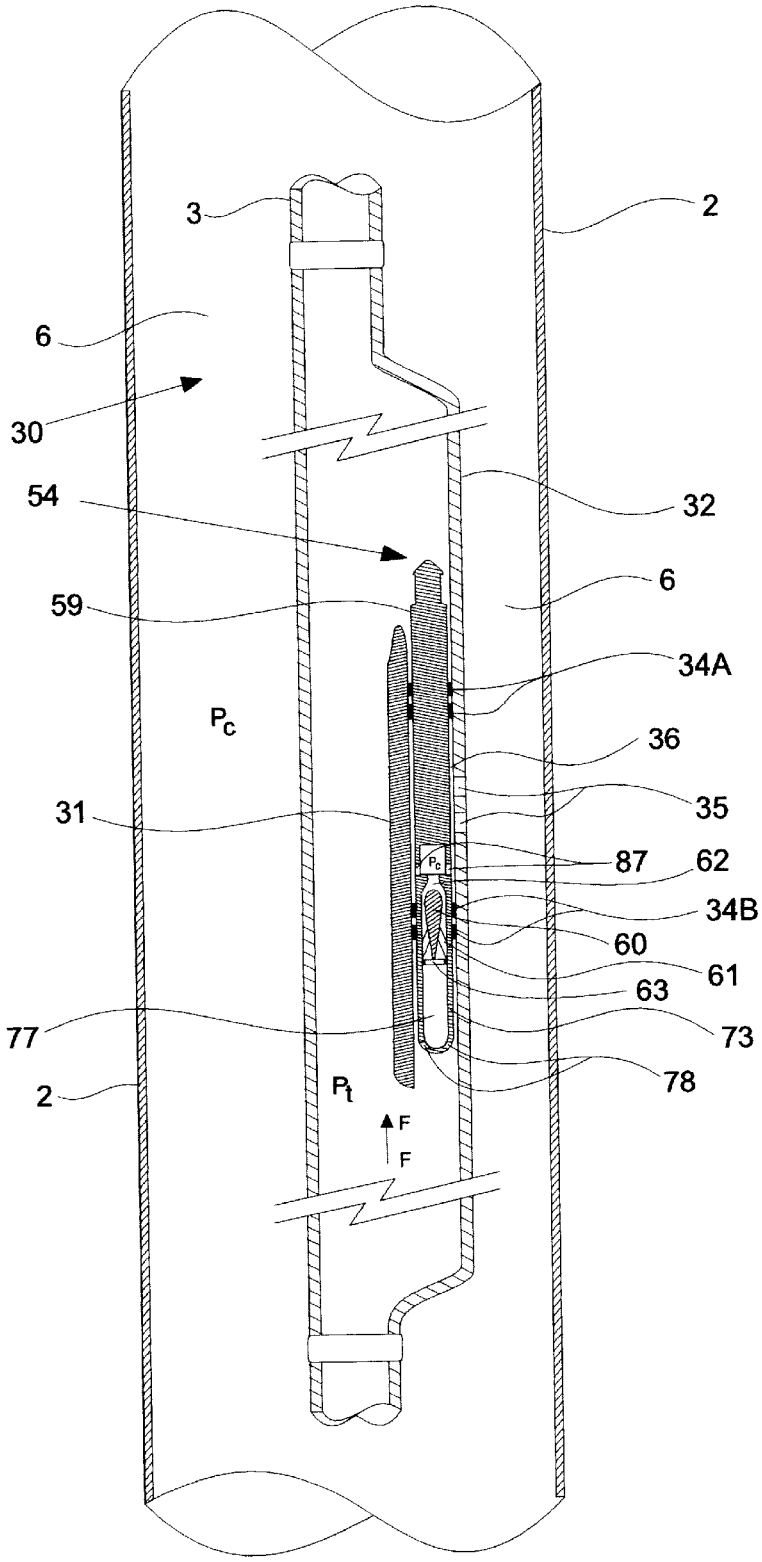
FIG. 9 is a longitudinal cross sectional view showing a side pocket gas lift mandrel in which a gas lift valve object of the present invention is inserted.

FIG. 9 depicts an embodiment of a gas lift valve 54 of the present invention, which should be used in a situation where a side pocket gas lift mandrel 30 is in use.

Gas lift valve 54 comprises a body 59, a central body venturi 60 provided with primary fins 61, an aerodynamically shaped seat 62, displacement limiters 63 and a hollow tip 73, which is provided with an internal chamber 77 having gas discharge ports 78 for discharging the high pressure injection gas.

Central body venturi 60, the primary fins 61, the aerodynamically shaped seat 62 and the displacement limiters 63 are respectively similar to the central body venturi 40, the primary fins 41, the aerodynamically shaped seat 42 and the displacement limiters 43 which were described with respect to FIG. 4, and the comments which have been made with regard to the latter are equally valid to the former.

Gas lift valve 54 is inserted in the side receptacle 31 of the side pocket 32 of the side pocket gas lift mandrel 30, where it is kept under pressure due to the compression exerted by the gaskets 34*a* and 34*b*, which also provide the necessary sealing between the body 59 of the venturi type gas lift valve 54 and the side receptacle 31.

Gas at a high pressure is able to penetrate the gas lift valve 54 through gas intake ports 87, passing then through seat 62, by the central body venturi 60 and entering the internal chamber 77, being exhausted through the gas discharge ports 78 into the side pocket gas lift mandrel 30.

Figure 10:
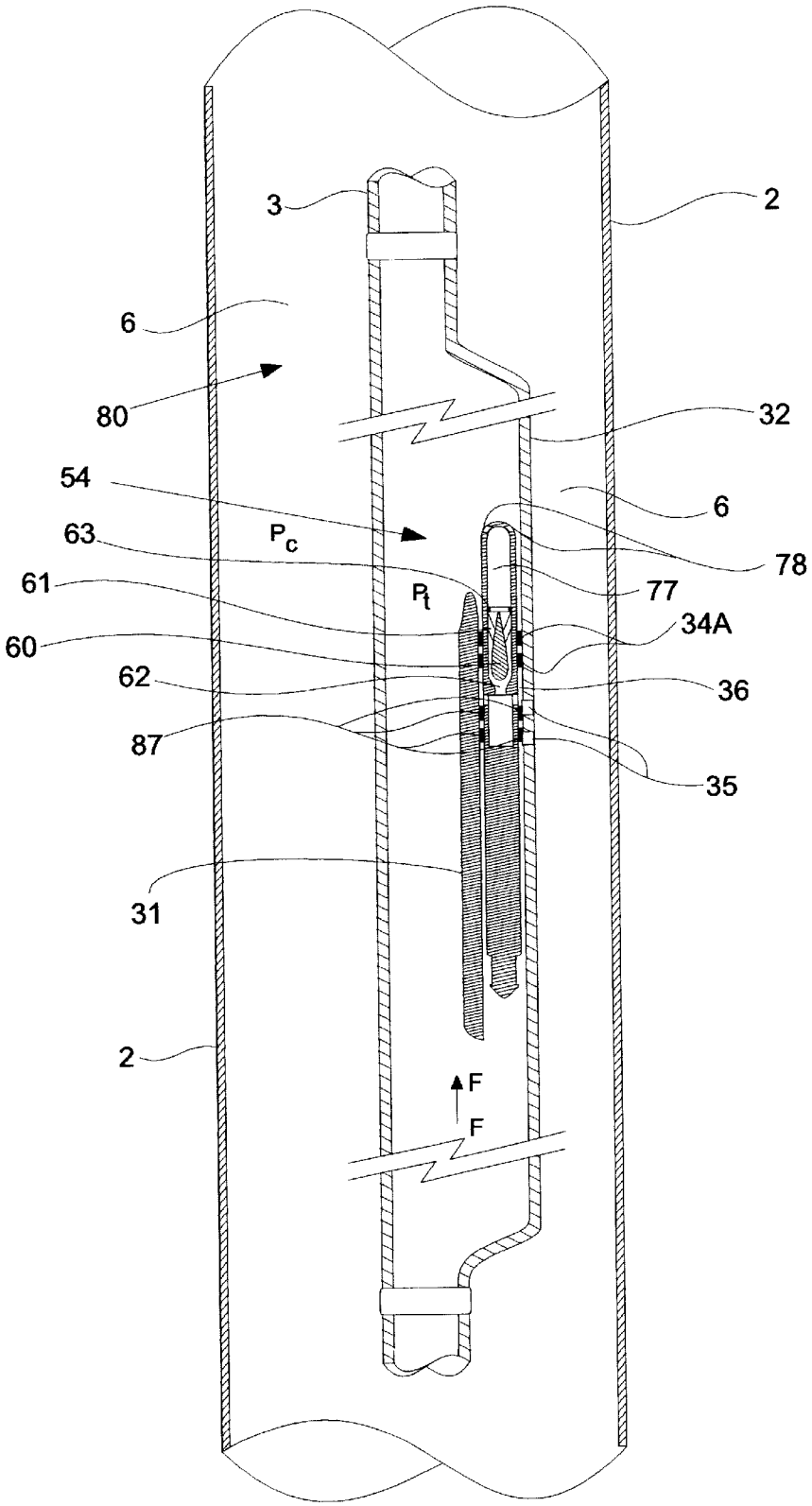
FIG. 10 is a longitudinal cross sectional view showing a side pocket gas lift mandrel in which a gas lift valve object of the present invention is inserted in an inverted position with regard to the position of FIG. 9.

FIG. 10 depicts a longitudinal cross sectional view of a side pocket gas lift mandril 80 in which the gas lift valve 54 is placed in an inverse position with regard to the usual position at which the gas lift valve is placed, shown in FIG. 9. In FIG. 10 the hollow tip 73 of the gas lift valve 54 is placed in such a way that it is in an uppermost position.

Side pocket gas lift mandril 80 is similar to the side pocket gas lift mandril 30 previously described, the only difference residing in the way the gas lift valve 54 is positioned therein. Therefore, the side pocket gas lift mandril 80 will not be described here again and its components are indicated in FIG. 10 by the same numeral reference.

As a consequence of the positioning of the gas lift valve 54 in the side pocket gas lift mandril 80, the injection of high pressure gas is made in the same direction of the flow of fluids coming from reservoir 1, indicated by the arrow F—F in the FIG. 10, and not in a direction which is contrary to the direction of the flow of oil occurring in the situation shown in FIG. 9, therefore precluding the losses of energy occurring in such situation.

In this new embodiment gas at a high pressure is injected in the gas lift mandrel 30 through the gas discharge ports 78 parallel to the flow of oil coming from reservoir 1. The positioning of the gas lift valve 54 as shown in FIG. 10 also facilitates blocking off of the gas lift valve in case of a reverse flow from the interior of the side pocket gas lift mandrel 80 to annulus 6 occurs.

The gas lift valve object of the present invention preferably makes use of a symmetric central body venturi. However, other configurations of central body venturis or nozzles can be used without departing from the teachings of the present invention.

Those skilled in the art will immediately recognise that there are a number of possibilities for varying the shape of the central body venturi, all of them being encompassed by the teachings of the present invention. The optimal dimensions of the central body venturi should be established by theoretical or experimental analysis or even empirically.

While the invention has been described heretofore with respect to the preferred embodiments, the invention is not limited to the content of the above description, and it is only limited to the content of the appendant claims.

List of Components

1 reservoir
2 casing
3 tubing
3*a* upstream segment
3*b* downstream segment
4 packer
5 lower chamber
6 annulus
7 orifice
8 processing facilities
9 external source of high pressure gas
10 oil well
11 safety equipments
12 conventional gas lift mandrel
13 body
14 gas lift valve
14' gas lift valve
15 side support
16 auxiliary supports
17 gas intake port
18 concentric venturi
19 (gas lift valve) body
20 (gas lift valve) internal chamber
21 shutter
22 seat
23 hollow tip
24 (side support) internal chamber
25 gas discharge opening
26 gas discharge port
30 side pocket gas lift mandrel
31 side receptacle
32 side pocket
33 hollow tip
34 gas lift valve
35 gas intake orifice
36 small annulus

37 (gas lift valve) internal chamber
38 gas discharge port
39 (gas lift valve) internal chamber
40 central body venturi
40' central body venturi
41 primary fin
41' secondary fin
42 seat
43 displacement limiter
44 opening
45 rail
46 bumper
47 gas intake port
48 spring
49 body
53 hollow tip
54 gas lift valve
56 gas discharge port
59 body
60 central body venturi
61 primary fin
62 seat
63 displacement limiter
73 hollow tip
77 (gas lift valve) internal chamber
78 gas discharge port
80 side pocket gas lift mandrel
87 gas intake port

What is claimed is:

1. A gas lift valve for use in a gas lift mandrel of an oil well producing by means of gas lift, the gas lift valve comprising:

a body;

a gas lift valve internal chamber having a first, original cross-sectional area;

at least one gas intake port for providing a passage for a flow of injection gas from an annulus between a casing and a tubing of said oil well to said gas lift valve internal chamber, said at least one gas intake port located in an upstream portion of said gas lift valve internal chamber; and a hollow tip, connected to said gas lift valve internal chamber, said hollow tip provided with at least one gas discharge port;

a central body venturi installed in said gas lift valve internal chamber, said central body venturi comprising:

a first divergent upstream segment, which provides, in said gas lift valve internal chamber, a progressive constriction in a cross sectional area from the original cross-sectional area for the passage of said flow of injection gas;

a second intermediate segment, located downstream of said first divergent upstream segment, which defines a substantially constant cross sectional area for the passage of said flow of injection gas, such area being substantially smaller than the original cross sectional area of said gas lift valve internal chamber;

a third convergent downstream segment, located downstream of said second intermediate segment, which defines a progressive widening in the cross section area for the passage of said flow of injection gas until such cross sectional area becomes equal to the original cross sectional area of said gas lift valve internal chamber; and a seat, located at said upstream portion of said gas lift valve internal chamber and downstream of said at least one gas intake port, said seat able to accommodate said first divergent upstream segment of said central body venturi against it, thereby blocking off said gas lift valve and therefore precluding a reverse flow from said gas lift mandrel to said annulus from occurring.

2. A gas lift valve according to claim 1 wherein:

said seat is integral with said body.

3. A gas lift valve according to claim 2 wherein:

primary fins are provided to said central body venturi, for centering said central body venturi in the gas lift valve internal chamber.

4. A gas lift valve according to claim 3, wherein:

secondary fins are provided to said central body venturi, for preventing said central body venturi from vibrating.

5. A gas lift valve according to claim 4, wherein:

said second intermediate segment is of a very short length comprising a circular segment where the inversion of the curvature from said first divergent upstream segment to said third convergent downstream segment of said central body venturi occurs.

6. A gas lift valve according to claim 5, wherein:

said central body venturi is hollow and is provided with at least one opening at the end of said third convergent downstream segment.

7. A gas lift valve according to claim 6, wherein:

it is provided with a spring located at a lower portion of said gas lift valve internal chamber, said spring accommodating to a lower portion of said third convergent lower segment of the central body venturi and urging the latter towards said seat, in a direction which is contrary to the direction of said flow of injection gas.

8. A gas lift valve according to claim 7, wherein:

said gas lift valve internal chamber is provided with at least one displacement limiter at its wall for limiting the displacement of said central body venturi towards said hollow tip.

9. A gas lift valve according to claim 8, wherein:

said at least one displacement limiter comprises a circular protrusion at the wall of said gas lift valve internal chamber.

10. A gas lift valve according to claim 8, wherein:

said at least one displacement limiter comprises a narrowing in the diameter of a downstream segment of said gas lift valve internal chamber.

11. A gas lift valve according to claim 7, wherein:

rails are provided in the wall of said gas lift valve internal chamber intended to serve as a guide to said primary fins, each of which being able to slide in a respective rail.

12. A gas lift valve according to claim 11, wherein:

at least one of said rails is provided with a bumper located at a lower portion of said at least one of said rails and near to said hollow tip, intended to act as a displacement limiter for its respective primary fin and consequently for said central body venturi.

13. A gas lift valve according to claim 1 wherein:

said seat is provided with an insert of a material of less superficial hardness than the superficial hardness of said first divergent upper segment of said central body venturi.

14. A gas lift valve according to claim 13 wherein:

primary fins are provided to said central body venturi, for centering said central body venturi in the gas lift valve internal chamber.

15. A gas lift valve according to claim 14, wherein:

secondary fins are provided to said central body venturi, for preventing said central body venturi from vibrating.

16. A gas lift valve according to claim 15, wherein:

said second intermediate segment is of a very short length comprising a circular segment where the inversion of the curvature from said first divergent upstream segment to said third convergent downstream segment of said central body venturi occurs.

17. A gas lift valve according to claim 16, wherein:

said central body venturi is hollow and is provided with at least one opening at the end of said third convergent downstream segment.

18. A gas lift valve according to claim 17, wherein:

it is provided with a spring located at a lower portion of said gas lift valve internal chamber, said spring accommodating to a lower portion of said third convergent lower segment of the central body venturi and urging the latter towards said seat, in a direction which is contrary to the direction of said flow of injection gas.

19. A gas lift valve according to claim 18, wherein:

said gas lift valve internal chamber is provided with at least one displacement limiter at its wall for limiting the displacement of said central body venturi towards said hollow tip.

20. A gas lift valve according to claim 19, wherein:

said at least one displacement limiter comprises a circular protrusion at the wall of said gas lift valve internal chamber.

21. A gas lift valve according to claim 19, wherein:

said at least one displacement limiter comprises a narrowing in the diameter of a downstream segment of said gas lift valve internal chamber.

22. A gas lift valve according to claim 18, wherein:

rails are provided in the wall of said gas lift valve internal chamber intended to serve as a guide to said primary fins, each of which being able to slide in a respective rail.

23. A gas lift valve according to claim 22, wherein:

at least one of said rails is provided with a bumper located at a lower portion of said at least one of said rails and near to said hollow tip, intended to act as a displacement limiter for its respective primary fin and consequently for said central body venturi.

24. A side pocket gas lift mandrel for use in an oil well producing by gas lift, said oil well extending from a surface to a reservoir and provided with a tubing and a casing, said side pocket gas lift mandrel comprising:

a body, provided with upstream and downstream ends which are able to connect to upstream and downstream segments of said tubing, respectively;

a side pocket fixed to said body and provided with a side receptacle for accommodating a gas lift valve having at one end a hollow tip provided with at least one gas discharge port through which injection gas from an annulus between said tubing and said casing is injected in said gas lift mandrel;

said side receptacle accommodates said gas lift valve in such a way that said hollow tip is in an uppermost position, allowing said injection gas to be injected at the same direction of a flow of fluids coming from said reservoir, thereby precluding losses of energy from occurring in said injection gas.

* * * * *